United States Patent [19]

Flaherty et al.

[11] 4,265,217

[45] May 5, 1981

[54] REMOTE FIREPLACE DAMPER CONTROL

[76] Inventors: Louis W. Flaherty; Harold H. Huber, both of No. 4-7th St. South, Great Falls, Mont. 59401

[21] Appl. No.: 42,497

[22] Filed: May 25, 1979

[51] Int. Cl.[3] ..... F23L 13/02

[52] U.S. Cl. ..... 126/288

[58] Field of Search ..... 126/288, 285 R, 285.5, 126/120, 295; 74/523, 524, 525

[56] References Cited

U.S. PATENT DOCUMENTS

| | | | |
|---|---|---|---|
| 599,335 | 2/1898 | Keifel et al. | 126/288 |
| 1,669,825 | 5/1928 | Guy | 126/288 |
| 3,094,114 | 6/1963 | Cage | 126/288 |
| 3,773,029 | 11/1973 | Kent | 126/288 |
| 3,880,142 | 4/1975 | Fowles | 126/288 |

*Primary Examiner*—James C. Yeung

*Attorney, Agent, or Firm*—Harvey B. Jacobson

[57] ABSTRACT

A lengthwise adjustable, vertically elongated bracket for depending support from the lintel of a fireplace and defining a guide opening therethrough at its lower end. An elongated horizontal lever assembly including first and second end aligned levers having adjacent and remote ends with the adjacent ends pivotally joined together through the utilization of pivot structure for relative oscillation of the levers about an upstanding axis. The remote end of the first lever may be pivotally connected to the lower end of a depending damper lever and the remote end of the second lever is slidably received through the guide opening. The lever assembly is shiftable lengthwise through the guide opening to a position with the adjacent end of the second lever completely displaced through the guide opening, after which the second lever may be pivoted about the pivot structure to a position disposed at generally right angles to the first lever. The pivot structure and second lever include coacting structure whereby the second lever may shifted longitudinally of the pivot structure and axis defined thereby and thus to a position spanning the guide opening.

10 Claims, 4 Drawing Figures

REMOTE FIREPLACE DAMPER CONTROL

BACKGROUND OF THE INVENTION

The use of fireplaces is enjoying renewed interest in view of the present energy crisis in this and other countries and, accordingly, many fireplaces which have been used only occasionally in the past are being used considerably more frequently.

When starting a fire in a fireplace, it is necessary to open the damper of the fireplace in order that the fire to be started therein may be subject to a proper draft and when the fire in a fireplace is extinguished it is desirable that the damper be closed in order to reduce the loss of heat from within the associated building upwardly through the fireplace flue. Therefore, the control of fireplace dampers is, for the most part, becoming more frequent.

Also, due to the close proximity of most fireplace damper control levers to the interior sooty portions of the associated fireplaces, persons adjusting the fireplace damper levers may have their clothing soiled.

Accordingly, a need exists for structure whereby the damper control lever of the fireplace may be more readily and conveniently controlled from in front of the lintel of the fireplace.

BRIEF DESCRIPTION OF THE INVENTION

The damper control of the instant invention is constructed in a manner whereby the associated damper lever may be readily adjusted from a position well in front of the lintel of the associated fireplace. In addition, the damper control is constructed in a manner whereby its operation may be quickly effected to open the damper in the event a fire has been started within the associated fireplace without the fireplace damper having been first opened. Also, the damper control is constructed in a manner whereby the control may be latched in a position with the damper lever in either full open position or the fully closed position thereof.

The main object of this invention is to provide a fireplace damper control constructed in a manner enabling the associated damper control lever to be readily actuated from a position forward of the lintel of the associated fireplace.

Another object of this invention is to provide a fireplace damper lever control which may be readily adapted for use in conjunction with a large majority of existing damper levers.

Still another object of this invention is to provide a damper control constructed in a manner whereby it may be actuated to lock the associated damper lever in a position with the associated damper in a full open position.

Also, it is another object of this invention to provide a damper control which may be utilized to lock the damper of the associated fireplace in a fully closed position.

A final object of this invention to be specifically enumerated herein is to provide a fireplace damper control in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
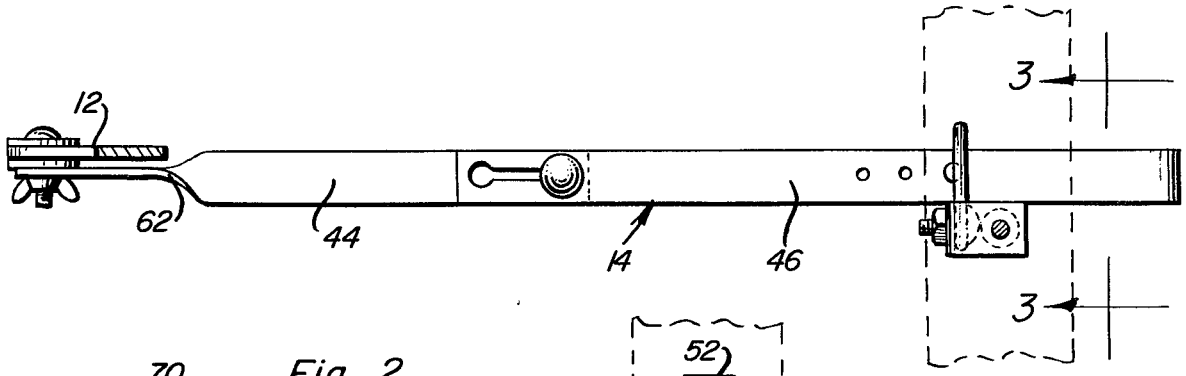
FIG. 1 is a top plan view of the damper control of the instant invention and with a portion of an associated damper lever being broken away and illustrated in horizontal section and an associated fireplace lintel illustrated in phantom lines, the control being position to close the associated damper.

Referring now more specifically to the drawings, the numeral 10 designates a fireplace lintel and the numeral 12 designates a depending damper control lever of the associated fireplace. The damper control of the instant invention is referred to in general by the reference numeral 14 and comprises a vertically elongated and adjustably extendible support structure referred to in general by the reference numeral 16. The support structure 16 includes an inverted L-shaped bracket 18 whose upper horizontal short leg 20 is secured to the underside of the lintel 10 through the utilization of the suitable fastener 22. The depending long leg 24 of the bracket 18 has a horizontal bore 26 formed through its lower end and the support structure 16 further includes a vertically adjustable lower portion 28 defining an upstanding slot 30 and a lower horizontal guide opening 32. A headed bolt 34 is secured to the bore 26 by means of a nut 36 and the head 38 of the bolt clampingly engages the legs 40 and 42 of the portion 28 defining the slot 30 whereby the lower portion 28 may be supported in adjusted downwardly extended position relative to the L-shaped bracket 18.

The damper control 14 further includes first and second control and operating levers 44 and 46 including overlapped adjacent ends. The adjacent end of the lever 44 has a vertical bore 48 formed therethrough and the adjacent end of the lever 46 has an elongated slot 50 formed therein terminating at its end adjacent the lever 44 in an enlarged slot portion 52. A pivot fastener 54 has a threaded cylindrical shank portion 56 secured through the bore 48 through the utilization of a nut 58 and the pivot fastener 54 includes an enlarged square shank portion 60 snugly slidably received in the slot 50 and tightly clamped against the opposing side of the lever 44, the axial extent of the portion 60 being greater than the thickness of the lever 46. Accordingly, the second operating lever 36 may be longitudinally shifted relative to the lever 44 and the pivot fastener 54.

The remote end of the lever 44 is twisted 90 degrees about its longitudinal axis as at 62 and the terminal end thereof is provided with longitudinally spaced horizontal apertures 64 through which a pivot fastener 66 is secured by a wing nut 68. The pivot fastener 66 is also secured through a horizontal bore 70 formed in the lower end of the damper lever 12. In this manner, the remote end of the lever 44 is pivotally attached to the lower end of the damper lever 12.

The longitudinal midportion of the lever 46 is provided with longitudinally spaced vertical apertures 72 through which an abutment fastener 74 is secured through the utilization of a threaded nut 76 and the remote end of the lever 46 includes a downturned end portion 78. The lever 46 is slidably received through the opening 32 and is therefore guided by the lower portion 28 of the support structure 16.

In operation, when it is desired to close the damper control of the associated fireplace, the levers 44 and 46 are positioned in the manner illustrated in FIG. 1 of the drawings with the pivot fastener 54 disposed in the end of the slot 50 remote from the lever 44 and the lower end of the abutment fastener 74 engaged with the lower horizontal member 80 of the lower portion 28 on the side thereof opposing the damper lever 12. The effective overall length of the levers 44 and 46 may be adjusted by securement of the fastener 66 in a selected bore 64 and by securement of the abutment fastener 74 through a selected aperture 72.

When it is desired to open the damper control of the associated fireplace, the downturned end 78 of the lever 46 is grasped and pulled until the lever 46 has been completely longitudinally shifted to the right in FIG. 1 of the drawings through the opening 32. At this point, the damper of the associated fireplace will be open and the enlarged square shank portion 60 of the fastener 54 will be disposed and rotatable in the enlarged slot portion 52 and the lever 46 may be swung horizontally 90 degrees so as to be disposed at generally right angles to the lever 44. Thereafter, the lever 46 is shifted longitudinally in an upward direction as viewed in FIG. 2 of the drawings relative to the pivot fastener 54 so as to bridge the opening 32 and prevent inward movement of the lever 44 of the associated fireplace and thus movement of the fireplace damper toward the closed position.

Figure 2:
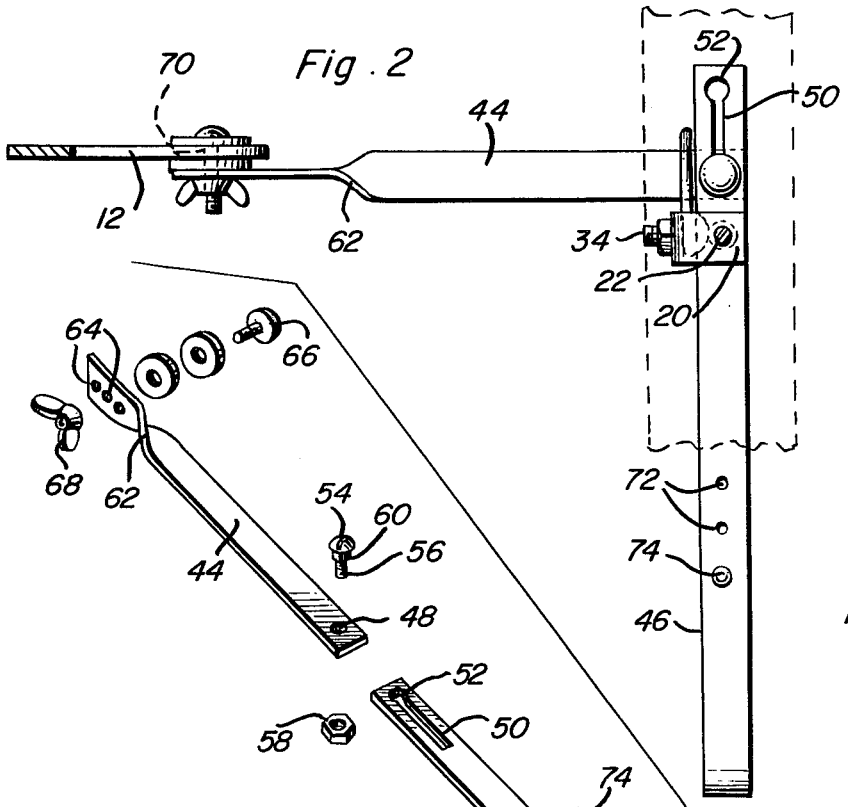
FIG. 2 is a plan view similar to FIG. 2 but with the control in a position to open the associated damper lever.
Figure 3:
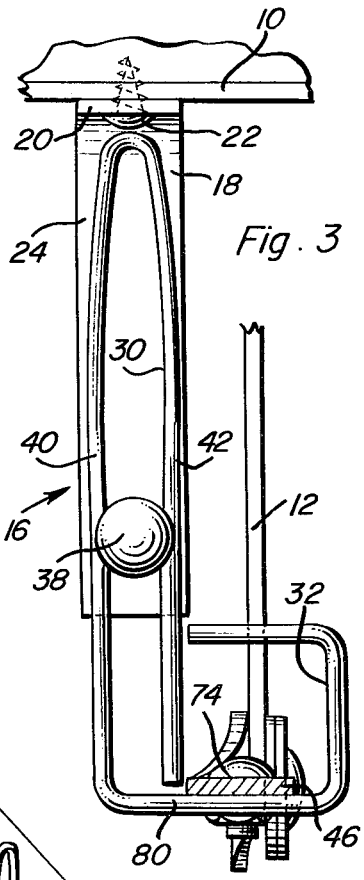
FIG. 3 is a fragmentary enlarged vertical sectional view taken substantially upon the plane indicated by the section line 3—3 of FIG. 1.
Figure 4:
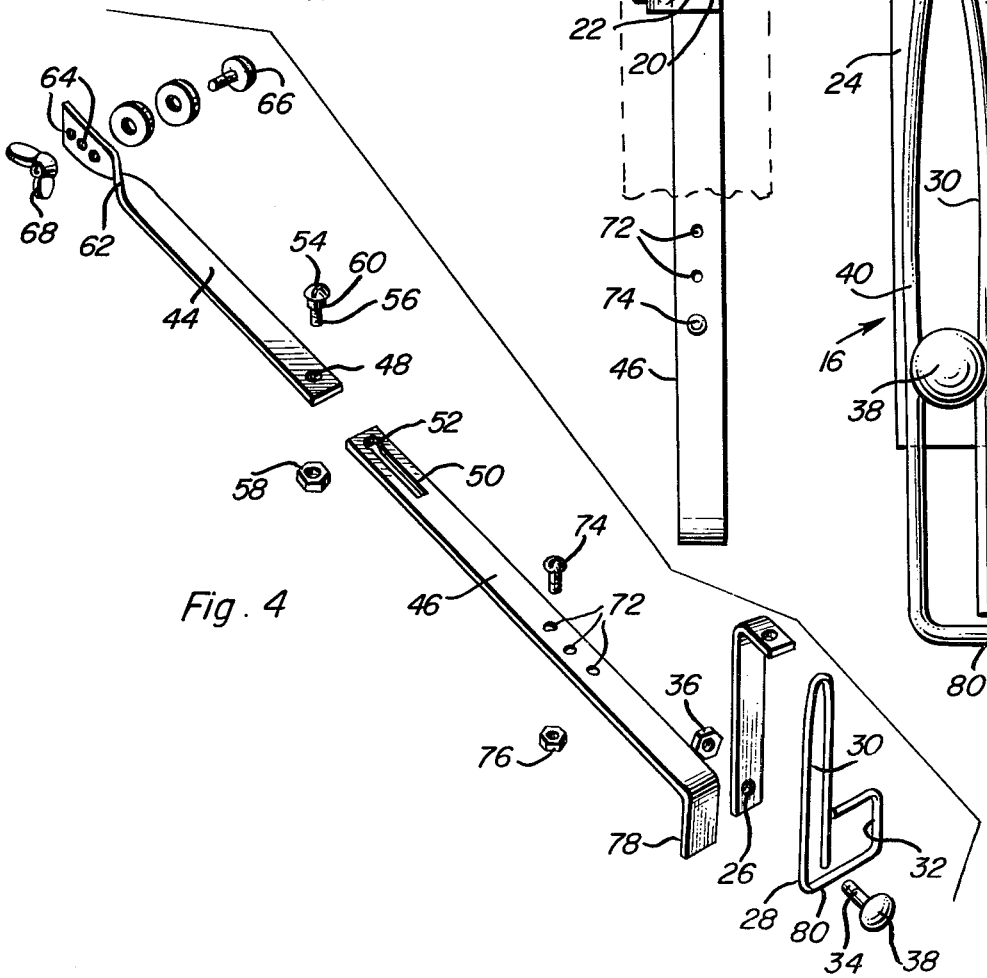
FIG. 4 is an exploded perspective view of the damper control.

Accordingly, when the damper control 14 is positioned as illustrated in FIG. 2, the damper control is locked in the open position and when the damper control 14 is in the position thereof illustrated in FIG. 1 of the drawings, the fireplace damper is locked in the closed position.

According to the height of the lintel 10 relative to the lower end of the damper lever 12, the lower portion 28 may be adjusted vertically relatively to the long leg 24 of the bracket 18 by loosening the nut 36, shifting the lower portion 28 vertically relatively to the long leg 24 and then retightening the nut 36.

In addition to the features already mentioned, the most important feature of this device is in energy savings as the control 14 insures positive locked down control when the fireplace is not in use.

The associated fireplace flue forms a natural draft and, when open, pulls heat out of the home up the chimney. A breeze or wind many times will cause sufficient draw on the chimney to partially open a conventional damper causing heat loss without the owner realizing it. The positive lock down of the control 14 prevents this from happening.

Further, a quick glance at the position of the control lever indicates if the damper has been left open and serves as a reminder to close the damper if the fireplace is not in use, thus avoiding costly heat loss.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A damper control for a fireplace including a fireplace opening upper limit defining lintel and a downwardly extending damper lever whose lower end is shiftable toward and away from the lintel from within the fireplace, said damper control including a support defining an upper portion for support from said lintel and a lower mounting portion, elongated horizontal operating and control levers, pivot means pivotally attaching first adjacent ends of said levers together for relative oscillation about a vertical axis transverse to said control and operative levers, said control lever including means on the remote end thereof for pivotal attachment to the lower end of said damper lever for oscillation relative thereto about a horizontal axis extending transversely of said damper and control levers, said lower mounting portion defining a guide opening therethrough through which the first end of said operating lever, said pivot means and the adjacent end of said control lever are guidingly projectable, said pivot means including means enabling limit longitudinal shifting of said operating lever relative to said vertical axis and control lever, whereby said operating lever may be longitudinally displaced through said opening, swung horizontally to a position disposed at generally right angles relatively to said control lever and then longitudinally shifted relative to said vertical axis and said control lever to a position spanning said guide opening through which the adjacent end of said control lever extends.

2. The combination of claim 1 wherein said means on the remote end of said control lever includes means operative to adjustably shift said horizontal axis relative to said control lever.

3. The combination of claim 1 wherein said pivot means includes a pin slot connection established between said operating and control lever by a pin supported from said control lever and a slot formed in said operating lever along which said pin is slidable.

4. The combination of claim 1 wherein said support includes means for adjustably vertically shifting the lower portion relative to the upper portion thereof.

5. The combination of claim 1 including abutment means carried by said operating lever and engageable with said lower portion to releasably lock said operating and control levers against movement relative to said lower portion toward said lintel from within the associated fireplace.

6. The combination of claim 5 wherein said abutment means and operating lever include means operative to adjustably position said abutment means along said operating lever.

7. The combination of claim 6 wherein said means on the remote end of said control lever includes means operative to adjustably shift said horizontal axis relative to said control lever.

8. The combination of claim 7 wherein said pivot means includes a pin slot connection established between said operating and control lever by a pin supported from said control lever and a slot formed in said operating lever along which said pin is slidable.

9. The combination of claim 8 wherein said support includes means for adjustably vertically shifting the lower portion relative to the upper portion thereof.

10. In combination with a fireplace defining a lintel and including a depending damper operating lever inward of said lintel, guide structure supported from said lintel and defining a guide opening therethrough extending in a front to rear horizontal direction relative to said fireplace, elongated arm structure having one end pivotally attached to the lower end of said damper operating lever for relative oscillation about a horizontal axis and the other end slidably received through said guide opening, said arm structure including first and second arms have adjacent ends pivotally connected together for relative oscillation about a transverse axis, the remote end of said first arm being pivotally attached to said damper control lever and the remote end portion of said second arm being slidably received through said guide opening, said adjacent ends of said first and second arms being pivotally secured together through the utilization of pivot structure enabling limited longitudinal shifting of said second arm relative to said pivot structure and said control lever, said arm structure being displaceable forwardly through said guide opening to a position with said adjacent end of said first arm and said pivot structure projected through said opening and said second arm disposed forwardly of said guide structure to enable said second arm to swing to a position generally 90 degrees relatively to said first arm and to thereafter be longitudinally shifted relative to said pivot structure and first arm to a position bridging said guide opening on the front side thereof.

* * * * *